US007798318B2

(12) United States Patent
Dwyre

(10) Patent No.: US 7,798,318 B2
(45) Date of Patent: Sep. 21, 2010

(54) PERSONALIZED PRESENTATION INSTRUMENT

(75) Inventor: Douglas P. Dwyre, Castle Rock, CO (US)

(73) Assignee: First Data Corporation, Greenwood Village, CO (US)

( * ) Notice: Subject to any disclaimer, the term of this patent is extended or adjusted under 35 U.S.C. 154(b) by 733 days.

(21) Appl. No.: 11/681,661

(22) Filed: Mar. 2, 2007

(65) Prior Publication Data

US 2007/0205134 A1 Sep. 6, 2007

Related U.S. Application Data

(60) Provisional application No. 60/779,916, filed on Mar. 6, 2006.

(51) Int. Cl.
*B65D 69/00* (2006.01)

(52) U.S. Cl. ..... 206/223; 206/224; 206/232; 206/449

(58) Field of Classification Search ..... 206/575, 206/576, 579, 232, 224, 305, 320, 449, 38, 206/223; 235/375, 380; 434/72, 81; 229/87.01, 229/92

See application file for complete search history.

(56) References Cited

U.S. PATENT DOCUMENTS 4,212,393 A * 7/1980 Lenkoff ..... 206/575
5,348,347 A * 9/1994 Shink ..... 206/576
6,673,408 B1 * 1/2004 Roth ..... 206/232
2004/0211830 A1 10/2004 Algiene
2005/0167487 A1 8/2005 Conlon et al.
2006/0090823 A1 * 5/2006 Repke et al. ..... 206/576
2006/0091028 A1 * 5/2006 Bastiaens et al. ..... 206/232
2007/0034545 A1 * 2/2007 Sabalaskey et al. ..... 206/575

OTHER PUBLICATIONS

Cover My Music (online), Nov. 20, 2004, retrieved Sep. 16, 2007 from the internet at website: http://web.archive.org/web/20041120110214/http://covermymusic.com/images.php?image_select=cdlabel, CD labels.

Nashua Media Products, Tera Media Corporation commercial website (online). Accessories, Feb. 3, 2003, RetrievedSep. 16, 2007 from the internet at: http://web.archive.org/web/20040203024725/http://www.nasua.com/accessories.html.

(Continued)

*Primary Examiner*—Luan K Bui
(74) *Attorney, Agent, or Firm*—Townsend and Townsend and Crew LLP

(57) ABSTRACT

Kits for making a personalized presentation instrument include a presentation instrument having a markable region and an information storage medium configured to store a unique identifier, a marking medium suitable for creating a mark on the markable region of the presentation instrument, and a package holding the presentation instrument and the marking medium. Personalizable presentation instruments for use in a transaction include a first side having a markable region, and a second side having an information storage medium that includes a unique identifier. Methods of personalizing a presentation instrument include providing a kit having a presentation instrument with a markable region and an information storage medium configured to store a unique identifier, and a marking medium suitable for creating a mark on the markable region of the presentation instrument, and creating a mark on the markable region of the presentation instrument with the marking medium to personalize the presentation instrument.

20 Claims, 3 Drawing Sheets

OTHER PUBLICATIONS

Oppenheim et al., Oppenheim Toy Portfolio 2005 Edition (online). Sep. 16, 2004, Retrieved Sep. 16, 2007. Oppenheim Toy Portfolio Gold Award 2004. Retrieved from the internet at: http://web.archive.org/web/20040916002050/http://www.toyportfolio.com/Earlyschool/ChapterSubChapter.asp?Chapter=Toys+Early+School+Years:+Five+to+Ten+Years&SubChapter=Activity+and+Craft+Kits&offset=90, Scratch-Lite Sketcher Scratch Art.

* cited by examiner

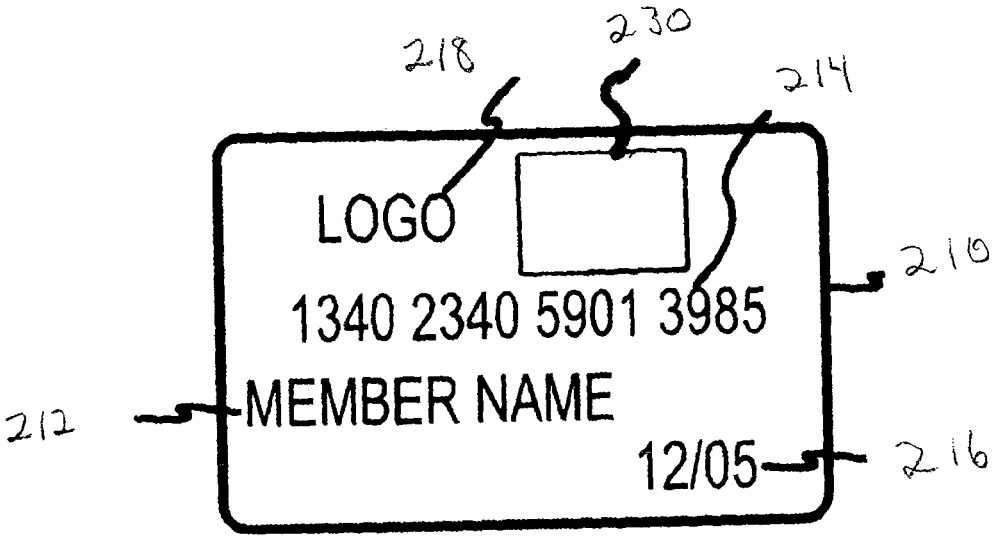
Fig. 2A
Fig. 2B
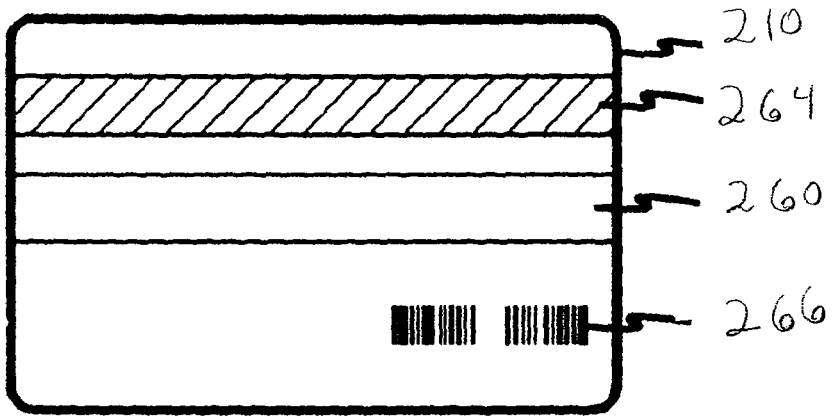

PERSONALIZED PRESENTATION INSTRUMENT

CROSS REFERENCE TO RELATED APPLICATION

This application is a nonprovisional of, and claims the benefit of the filing date, of U.S. Provisional Application No. 60/779,916, filed Mar. 6, 2006, the entire disclosure of which is incorporated herein by reference for all purposes.

BACKGROUND OF THE INVENTION

The present invention generally relates to transactional presentation instruments. More particularly, the present invention relates to personalizable transactional presentation instrument kits, systems and devices, and to methods for using and constructing such instruments.

Presentation instruments such as transaction cards, credit cards, debit cards, ATM cards, bank cards, stored value cards, gift cards, or the like, are well known for providing consumers with access to goods and services and are increasingly replacing other types of tender in consumer transactions. Such instruments may include a variety of different pre-printed indicia to identify the instrument and other features, such as the instrument issuer, the customer, terms and conditions of use, or the like, depending in part on the type of instrument. The information may be printed on the instrument using alphanumeric characters, graphics, or the like, or may be embossed into the instrument.

Stored value cards, such as gift cards, pre-paid metered accounts, and the like, are well-known for providing access to goods and services. For example, stored value, or gift cards, may be purchased or obtained from various merchants such as Target®, Wal-Mart®, Starbucks®, Sears®, Blockbuster®, Macy's®, Banana Republic®, and the like. The purchase and usage of financial presentation instruments has continued to increase in recent years to the point that the sale of stored value cards today is a multi-billion dollar industry.

Often, such instruments are created to contain graphics and other printed designs to provide marketing opportunities to card issuers and aesthetic appeal to card users. Relatedly, such features on presentation instruments can often serve as a convenient ice-breaker that allows individuals to express themselves. However, these features are typically placed on the instrument by the instrument manufacturer. Relatedly, many known instruments may not be well suited for personalization by the instrument user. For these and other reasons, there is a need for improved approaches for providing personalizable presentation instruments that enhance user interest and aesthetic enjoyment of such instruments.

The instant invention addresses this unfulfilled need by providing kits, systems, devices, and methods for making personalized presentation instruments. Such instruments may be customized to include unique markings for identifying the instrument among other instruments, or to include amusing or ornamental features for those who view or otherwise use the instruments. Such personalized instruments can effectively establish a tangible connection between a business and a consumer. When the instrument is created, and each time the instrument is used, a business brand can be seen, an image can be projected, and customer loyalty can be strengthened.

BRIEF SUMMARY OF THE INVENTION

Advantageously, the present invention provides personalizable presentation instruments that are well suited for elevating or enhancing the experience of anyone using such items. For example, presentation instruments can include unusual ornamentation that adds value to the instrument as a collector item, or reflects the personality of the user. Similarly, personalizable features on the instrument can be selected by the user so as to coordinate with their clothing or other fashion accessories, or to accommodate various artistic or thematic preferences. In some instances, a presentation instrument may be adorned with unique or otherwise identifying markings so as to allow the user to distinguish that presentation instrument from another otherwise similar presentation instrument. Further, it would be advantageous to have a pre-packaged kit conveniently and inexpensively designed to contain all the materials required to make a personalized presentation instrument.

In a first aspect, embodiments of the present invention provide a kit for use in making a personalized presentation instrument. The kit can include a presentation instrument having a markable region and an information storage medium configured to store a unique identifier, a marking medium suitable for creating a mark on the markable region of the presentation instrument, and a package holding the presentation instrument and the marking medium. The kit can also include a marking instrument for applying the marking medium to the markable region of the presentation instrument. In some cases, the kit can include a set of instructions for using the marking medium to create a mark on the markable region of the presentation instrument. In some embodiments, the markable region can be disposed on a surface of the presentation instrument. The markable region can define an entire surface of the presentation instrument. Alternatively, the markable region can define a portion of a surface of the presentation instrument. In some cases, the markable region is visible from one side of the presentation instrument. The kit may also include a stencil for use in creating a patterned mark on the markable region of the presentation instrument. In some cases, the kit may include an adhesive tag suitable for application to a surface of the presentation instrument. The marking medium can be suitable for creating a non-smearing mark on the markable region of the presentation instrument. The marking medium can be suitable for creating a visible mark on the markable region of the presentation instrument. In some cases, the marking medium can be suitable for creating an invisible mark on the markable region of the presentation instrument. In related cases, the marking medium can be suitable for creating an erasable mark on the markable region of the presentation instrument. In some embodiments, the marking medium can be suitable for creating an erasable mark on the markable region of the presentation instrument, such that the erasable mark can be made permanent upon activation of the mark. In some embodiments, the marking medium can be suitable for creating a permanent mark on the markable region of the presentation instrument.

In another aspect, embodiments of the present invention provide a personalizable presentation instrument for use in a transaction. The personalizable presentation instrument can include a first side having a markable region, and a second side having an information storage medium that includes a unique identifier. The second side of the instrument can include a signature panel. The signature panel can be adjacent to the information storage medium. In some cases, the markable region can include a designated customer markable region.

In another aspect, embodiments of the present invention provide a method of personalizing a presentation instrument. The method can include providing a kit that includes a presentation instrument having a markable region and an information storage medium configured to store a unique identifier, and a marking medium suitable for creating a mark on the markable region of the presentation instrument. The method can also include creating a mark on the markable region of the presentation instrument with the marking medium so as to personalize the presentation instrument.

BRIEF DESCRIPTION OF THE DRAWINGS

FIGS. 2A and 2B illustrate personalizable presentation instruments according to embodiments of the present invention.

DETAILED DESCRIPTION OF THE INVENTION

Figure 1:
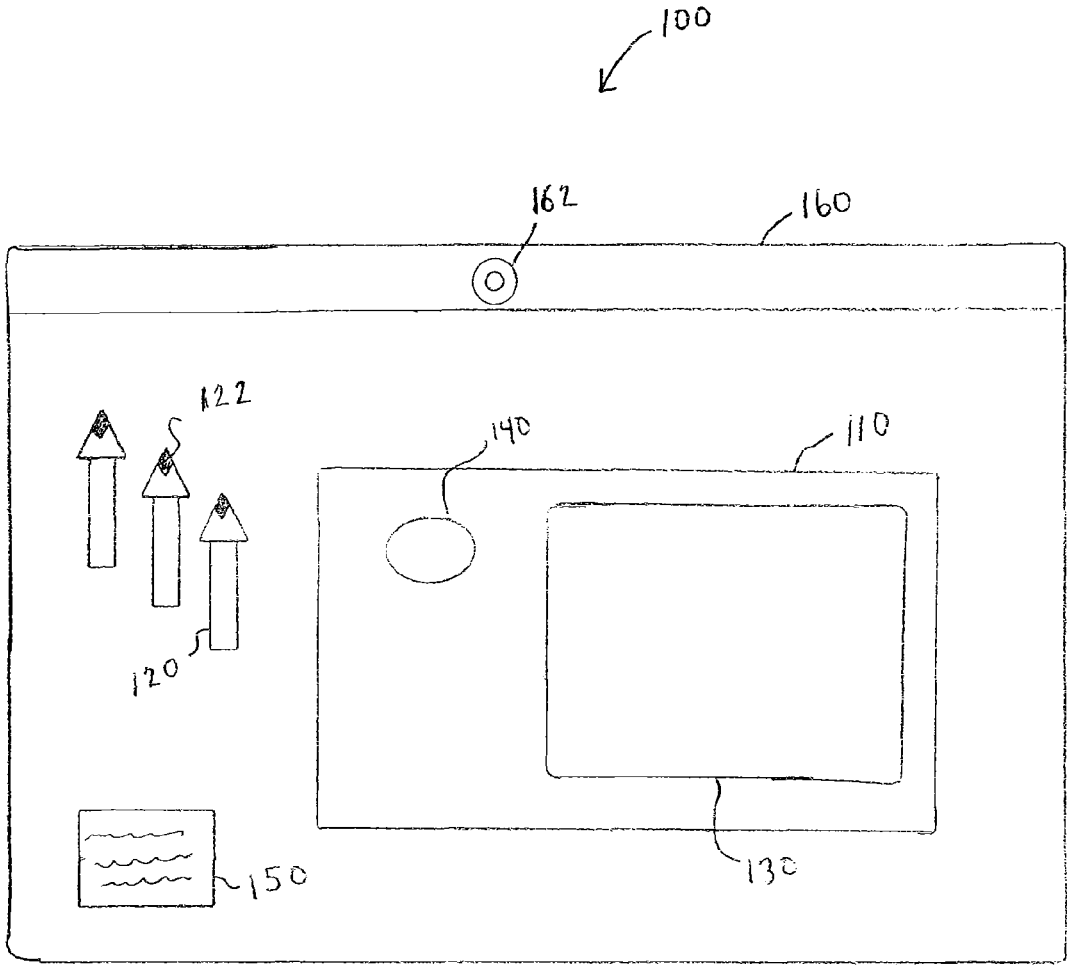
FIG. 1 illustrates an exemplary personalizable transactional presentation instrument kit according to embodiments of the present invention.

In some embodiments, the present invention generally provides personalized transactional presentation instrument systems, as well as methods of using and assembling such systems. Turning now to the drawings, FIG. 1 illustrates an exemplary kit 100 according to one embodiment of the present invention. Kit 100 includes a presentation instrument 110, and at least one marking instrument 120. Presentation instrument 110 includes a markable region 130, and an information storage medium 140 configured to store a unique identifier. Optionally, kit 100 includes a set of instructions 150 for using marking instrument 120 to create a mark on markable region 130. Kit 100 may also include a package 160 for holding presentation instrument 110, marking instrument 120, and instructions 130, or any combination thereof.

In one embodiment, a person, for example a child, may apply marks to markable region 130 of presentation instrument 110 (e.g. gift card, spending card, or prepaid card) with marking instrument 120, so as to create a personalized instrument. The person may then give instrument 110 to a recipient, such as a grandparent, who in turn will enjoy use of instrument 110 when making purchases or other value transactions. In related embodiments, kit 100 may be sold at a retail location, ordered through a catalog, or purchased though a communication modality such as the Internet. In some embodiments, kit 100 may be provided to a consumer or user as a promotional gift item via a targeted mailing or other distribution channel.

Presentation instrument 110 and markable region 130 may be manufactured from any of a variety of materials or combinations of materials such as plastics, polymers, or paper, including, but without limitation to, styrene, polyvinyl chloride (PVC), laminated PVC, polyethylene terephthalate (PET) or polyester, glycolized polyester (PETG), vinyl, and cardboard. The materials may include a clear transparent material, a tinted or colored transparent material, a colored opaque material, and the like. Relatedly, presentation instrument 110 and markable region 130 may be coated with or include a reflective material. In some instances, instrument 110 may include photographs or other graphic or text images. Instrument 110 or markable region 130 may be finished with a various coatings such as a frosted varnish, a press polish, a matte, an ISO laminate, and the like. Features of instrument 110 or markable region 130 can include foils, holograms, or lenticular images, video displays, and the like. In some aspects, at least some of these features may confer security protection for instrument 110. A mark on markable region 130 may be visible from a single side of presentation instrument 110, or the mark may be visible from multiple sides of presentation instrument 110.

Markable region 130 may include a writable coating or otherwise present a writable surface for marking. Markable region 130 may cover all or a portion of a surface of instrument 110. In some embodiments, markable region 130 includes a material that absorbs a marking medium from marking instrument 120. Markable region 130 may be any desired or suitable color, and may have, for example, a glossy or matte finish, or include a frosted varnish. Markable region 130 may include patterns or other designs. Markable region 130 may be integral with presentation instrument 110, or markable region 130 may be separately applied to presentation instrument 110. In some embodiments, presentation instrument 110 is a flat object such as a card, and includes one or more markable regions 130 on a front side of the card, a back side of the card, or on both sides of the card. In some embodiments, markable region 130 may be specifically designated as a markable region by an indicia on presentation instrument 110, or by an indicia on an instrument carrier, on an insert, or on some other item or communication associated with or related to presentation instrument 110. In related embodiments, such a markable region may be designated as a customer markable region.

Marking instrument 120 is typically configured to produce a visible or otherwise detectable mark on markable region 130 of presentation instrument 110. Marking instrument 120 may be, for example, a pen, a pencil, a marker, a highlighter, a dauber, or the like. Marking instrument 120 may include or be fabricated from any of a variety of marking medium 122. For example, in some embodiments, marking medium 122 may be suitable for creating a non-smearing mark on markable region 130. In some cases, marking medium 122 may be suitable for creating an invisible mark on markable region 130. Marking medium 122 may also be configured to create a permanent mark on markable region 130. In another example, marking medium 122 maybe suitable for creating an erasable mark on markable region 130. In some related aspects, the erasable mark may be made permanent upon activation of the mark. Marking medium 122 may include various pigment types. For example, marking medium 122 may include a pigment containing special carbon black, iron oxide, complex inorganic, ultramarine, chromium oxide, chromate, cadmium, azo, phthalocyanine, quinacridone, and the like. Relatedly, the pigment can be a light reflective pigment, a luminescent pigment, a phosphorescent pigment, a fluorescent pigment, a pearlescent pigment, an iridescent pigment, a transparent pigment, a metallic pigment, and the like. Marking medium 122 may be of any color, including red, orange, yellow, green, blue, indigo, violet, black, and white. Marking medium include inks, toners, paints, dyes, pigments, colorants, and the like. Marking medium 122 may be an erasable medium that is made permanent upon activation by light, heat, or the like. In some embodiments, marking medium 122 will be water resistant and adhere to most surfaces. In some embodiments, marking instrument 120 may be a permanent marker, such as a Sharpie® pen. In some embodiments, marking instrument 120 may include an image of a logo, a brand, or some other promotional graphic or advertisement insignia.

In some embodiments, kit 100 may include a container that holds a marking medium. For example, kit 100 may include a canister of paint, or a pad containing a marking medium. Such a container may replace or be in addition to marking instrument 120. In some cases, kit 100 may include a container that holds a marking medium, along with a marking medium applicator such as a paintbrush, a sponge, a rubber stamp, or a brayer. In some embodiments, kit 100 may include any combination of marking instrument 120, marking medium container, and marking medium applicator. Kit 100 may also include a stencil that can be used in creating a patterned mark on markable region 130 of presentation instrument 110. In some cases, kit 100 may include an adhesive tag such as a sticker than can be applied to the surface of presentation instrument 110.

It is appreciated that presentation instrument 110 may comprise a variety of shapes and sizes depending on how it is to be displayed, packaged, and/or used, and as such is not limited to conventional standard size credit cards. Presentation instrument 110 may comprise any rectangular, circular, semi circular, oval, elliptical, rectangle, square, triangle, star, polygonal, regular, or irregular shape. In some instances, the design of instrument 110 may be indicative of a merchant's business. For example, the shape of instrument 110 may be in the form of a store front, shoes, athletic equipment (e.g., football, baseball, tennis racket), food products (e.g., pizza, donuts), beverage products, cars, animals, cartoon characters, consumers goods, and the like. Instrument 110 may also include an aperture or other means for coupling instrument 110 with to another object (e.g., keychain, fob, necklace).

Information may be included on presentation instrument 110, such as instructional information, advertising branding, promotional information, trademarks, website address, logos, graphics, a signature block or strip, or other elements for transaction processing. Presentation instrument 110 may include a variety of different indicia to identify the instrument and other features, such as the instrument issuer, the customer, an account, terms and conditions of use, or the like, depending in part on the type of instrument. Instrument 110 can also include indicia associated with vendors, merchants and/or service providers that sponsor or accept instrument 110. The information may be printed on the instrument using alphanumeric characters, graphics, or the like, or may be embossed into instrument 110. It is also understood that the indicia may be confined exclusively to a portion of the body of presentation instrument 110, or it may overlap various portions of presentation instrument 110 such as markable region 130 or information storage medium 140. Indicia may also be presented on one or more sides of presentation instrument 110. For example, instrument 110 may have a display side for promotional graphics and logos, and an instruction side that is opposite the display side that has instructional information, terms and conditions, and the like, for using instrument 110. The indicia may be included as part of the information used to activate presentation instrument 110.

Information storage medium 140 of presentation instrument 110 may include a magnetic strip or bar code that is adapted to store a unique identifier so that the user's account may be properly accessed, activated, and/or debited. Information storage medium 140 can also comprise radio frequency identification, computer chips, or other magnetic, radio frequency, or electronic storage media that may be readable by existing card reader technology, such as a point of sale ("POS") terminal, or that may be otherwise adapted to store a unique identifier so that the user's account may be properly accessed, activated, and/or debited by existing or future instrument reader technology. For example, some or all the information may be encoded on instrument 110, such as in a magnetic strip on the back side of instrument 110 that can store information, such as an account number, which can be read by a point of sale terminal.

For many conventional contact transaction cards, the dimensions of presentation instrument 110 may be at least somewhat dictated by the requirements of the contact interface. As noted above, conventional transaction cards may include magnetic strip that contacts a strip reader on a point of sale terminal when a user swipes the card to make a purchase or payment. In order to ensure interoperability between the magnetic strip readers and cards bearing magnetic strips, the parameters defining the magnetic strip are governed by the International Organization for Standardization (ISO) and the International Electrotechnical Commission (IEC). ISO/IEC 7811 provides standards for the physical characteristics of the magnetic strip including the location of the strip on the card, the surface profile of the strip, and the height of the strip above the card surface. In some cases, presentation instrument 110 can be a rectangular shape having standard credit card dimensions of approximately 2⅛ inches high, 3⅜ inches long, ⅛ of an inch corner radius, and 0.75 mm thick. It is appreciated that presentation instrument 100 may also be configured to conform with additional or alternative ISO standards, including, for example, standards 7810, 7816, and 8583.

In some cases, presentation instrument 110 may have a standard or non-standard shape and size. Instrument 110 may be a chip card, an integrated circuit cart, a smart card, and the like. For example, instrument 110 may include a contactless integrated circuit such as a smart chip that allows transactions to be conducted without physical contact between instrument 110 and a transaction processing device at the point of sale. In some embodiments, information storage medium 140 can include a contactless integrated circuit chip, which may have a wireless transmitter and/or receiver for exchanging information with a presentation instrument reader. Markable region 130 may be superimposed over such an integrated circuit contained in presentation instrument 110. The chip may include an antenna for transmitting and receiving information associated with the transaction on a modulated RF carrier signal. A contactless IC chip may be designed to conform to ISO/IEC standards for contactless integrated circuit cards and proximity cards, including the ISO/IEC 14443 standard, and/or the ISO/IEC 15693 standard, among others. It is appreciated that the microprocessor may be programmed to make decisions about any stored or input data. Thus, in some embodiments, information storage medium 140 may include a memory, a processor, or a combination thereof. Information storage medium 140 may also include security features to prevent access to information contained thereon, or to otherwise provide a secure environment. In addition to contactless technology, the present invention also contemplates the inclusion of contact technology into instrument 110. In some embodiments, information storage medium 140 may include gold surface contacts to provide a suitable electrical connection interface. It is also appreciated that information storage medium 140 may also include an optical memory component.

Presentation instrument 110 may include a variety of sizes, including but not limited to, standard sized credit cards such as the 3⅜ inches by 2⅛ inches by 0.03 inches thick conventional CR 80 type card. In some embodiments, instrument 110 may have a thickness in the range from between about 10 mil. (0.25 mm) to about 30 mil. (0.76 mm). Embodiments of the present invention, for example, include presentation instruments 110 with a conventional rectangular shape, and dimensions of less than 3⅜ inches in width and less than 2⅛ inches in height, such as a minicard. Presentation instrument 110 may also be larger than standard-sized cards, although in some cases it may be desirable for presentation instrument 110 to have a size that is practical for being carried in a purse, wallet, pants pocket, and the like. It is understood, however, that presentation instrument 110 can be provided in virtually any form imaginable. For example, presentation instrument 110 can be provided in the form of a baseball cap, a necklace, a bracelet, shoes, a teddy bear, and the like. Such an instrument can be provided for sale to children at an amusement park, enabling the child to wear or carry the item, and have value decremented automatically as she partakes in amusements, or incremented automatically as she gains points in contests involving skill, chance, or a combination thereof.

Package 160 typically includes a plastic pouch or envelope, although embodiments of the present invention contemplate the use of any of a variety of containers suitable for holding presentation instrument 110, marking medium 122, and marking instrument 120. In some embodiments, package 160 may be constructed of or include a transparent material so that contents contained inside of package 160 can be visible from outside of package 160. In some cases, package 160 may include or be attached with an aperture or clasp 162 for attaching package 160 with a retail display.

FIG. 2A illustrates a presentation instrument 210 according to one embodiment of the present invention. Presentation instrument 210 may in some instances be what consumers commonly recognize as a credit card or debit card. One side of the card can be embossed with the member's name 212, an account number 214, an expiration date 216, and the like. The card may have a logo 218 of a payer, card issuer, or other commercial entity. Accordingly, it is appreciated that presentation instrument 210 may include any of a variety of logos, brands, or other promotional graphics or advertisement insignia. Relatedly, presentation instrument 210 may be devoid of such features, and instead be entirely blank. As shown here, presentation instrument 210 includes a markable region 230. Additionally, card 210 may have other recognizable features that identify it as a branded credit card. As shown in FIG. 2B, the back side of instrument 210 may include a signature panel or line 260. Presentation instrument 210 may include one or more information encoding features such as an information storage medium. Information encoding features may include a magnetic stripe 264, a bar code 266, a smart chip (not shown), and the like. It is to be understood that many other examples of presentation instrument 210 and associated information encoding features are possible. In some embodiments, instrument 210 may include a magnetic stripe configuration having attributes in three tracks. Track 1 can include, for example, a card number and cardholder name. Track 2 can include information that can be used for debiting or crediting an account. In some cases, tracks 1 and 2 can contain Mastercard®/Visa® requirements. Track 3 can be configured to support other financial or security applications. In some embodiments, presentation instrument 210 may support swipe-less functionality whereby information can be read from instrument 210 by waving it in front of or near a reader configured for this purpose. Such a reader can be integral to or otherwise connected with the terminal. Such an approach may employ RFID technology. Barcode 266 may be any barcode type, including without limitation barcodes such as U.P.C./EAN, Code 128, Interleaved 2 of 5, and Code 39. In some embodiments, presentation instrument 210 includes a first side and a second side. The first side of presentation instrument 210 may include a writable surface or coating such as markable region 230, and the second side of presentation instrument 210 may include an information encoding feature such as magnetic stripe 264 that holds an account number. In related embodiments, the second side of presentation instrument 210 includes signature panel 260 which can be located adjacent to magnetic stripe 264.

It is appreciated that presentation instrument 210 can be any of a variety of transaction instruments, including credit cards such as VISA®, MasterCard®, and American Express®, debit cards such as ATM cards, bank cards, prepaid phone cards and other phone cards, airline cards, frequent buyer cards, casino cards and other membership cards, hotel room cards and other access cards, insurance cards, library cards, discount cards, entertainment cards, travel cards, supermarket check-out cards, retail store charge cards, reward cards, gift cards, loyalty cards, promotional cards, vending machine cards, incentive cards, calendar cards, prepaid debit cards, toll booth cards, voter cards, restaurant tip cards, driver's licenses or other identification cards, various stored value cards, or any other type of financial, healthcare, identification, or transaction presentation instrument, and the like. Instrument 210 can also be any apparatus that interacts with a point-of-sale or point-of-care system to settle a transaction. In some embodiments, a retailer or financial institution brand (e.g., Toys-R-Us®) may be partnered with a marking instrument manufacturer brand (e.g., Crayola®) to provide customers with a co-branded instrument 210 such as a gift card that may be used for purchases at Toys-R-Us® stores or for Toys-R-Us® merchandise ordered via a catalog or an electronic storefront (i.e., web site). Exemplary presentation instruments are further discussed in U.S. patent application Ser. No. 09/971,303 filed Oct. 3, 2001, Ser. No. 10/421,604 filed Apr. 22, 2003, Ser. No. 10/922,815 filed Aug. 19, 2004, Ser. No. 10/959,637 filed Oct. 5, 2004, Ser. No. 11/153,218 filed Jun. 14, 2005, Ser. No. 11/155,323 filed Jun. 17, 2005, and Ser. No. 11/233,947 filed Sep. 22, 2005, the entire contents of each of which are incorporated herein by reference.

Figure 3:
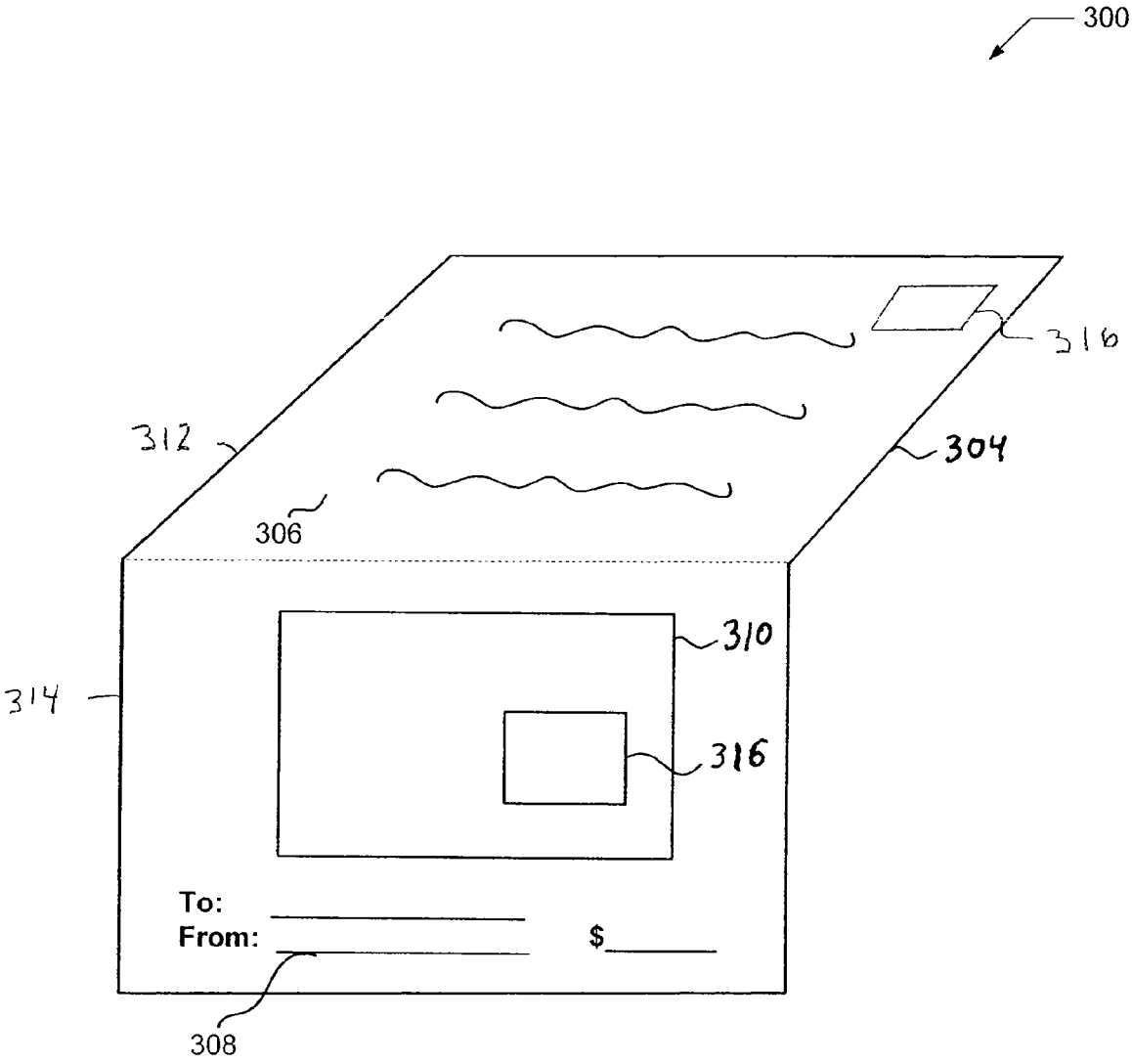
FIG. 3 depicts a presentation instrument assembly according to embodiments of the present invention.

FIG. 3 illustrates an embodiment of a presentation instrument assembly 300 according to embodiments of the invention. Assembly 300 can include an instrument carrier 304 and a presentation instrument 310. In some embodiments, instrument carrier 304 is constructed of cardboard stock. Instrument 310 may be attached or affixed with carrier 305 in any of a number of ways. Carrier 304 may include instructions 306 for activating instrument 310 and blanks 308 into which a customer may enter information such as the recipient and the instrument value amount. Conveniently, carrier 304 may be perforated so that an activation instructions section 312 may be separated from an instrument section 314. Instrument 310 or carrier 304 may include a logo or brand 316.

Although certain system, device, and method embodiments have been disclosed herein, it will be apparent from the foregoing disclosure to those skilled in the art that variations, modifications, alternative constructions, and equivalents of such embodiments may be made without departing from the true spirit and scope of the invention. Therefore, the above description should not be taken as limiting the scope of the invention which is defined by the appended claims.

What is claimed is:

1. A kit for use in making a personalized presentation instrument, comprising:

a presentation instrument having a first side comprising a markable region and a second side opposite the first side comprising an information storage medium configured to store a unique identifier associated with a user account;

a marking medium suitable for creating a mark on the markable region of the presentation instrument; and a package holding the presentation instrument and the marking medium, wherein the package holding the presentation instrument and the marking medium comprises a perforated cardboard stock instrument carrier having an instrument section and an activation instructions section, wherein the activation instructions section comprises instructions for activating the presentation instrument, and wherein the presentation instrument is coupled with the instrument section.

2. The kit according to claim 1, further comprising a marking instrument for applying the marking medium to the markable region of the presentation instrument.

3. The kit according to claim 1, further comprising a set of instructions for using the marking medium to create a mark on the markable region of the presentation instrument.

4. The kit according to claim 1, wherein the markable region is disposed on a surface of the presentation instrument.

5. The kit according to claim 1, wherein the markable region defines an entire surface of the presentation instrument.

6. The kit according to claim 1, wherein the markable region defines a portion of a surface of the presentation instrument.

7. The kit according to claim 1, wherein the markable region is visible from one side of the presentation instrument.

8. The kit according to claim 1, further comprising a stencil for use in creating a patterned mark on the markable region of the presentation instrument.

9. The kit according to claim 1, further comprising an adhesive tag suitable for application to a surface of the presentation instrument.

10. The kit according to claim 1, wherein the marking medium is suitable for creating a non-smearing mark on the markable region of the presentation instrument.

11. The kit according to claim 1, wherein the marking medium is suitable for creating a visible mark on the markable region of the presentation instrument.

12. The kit according to claim 1, wherein the marking medium is suitable for creating an invisible mark on the markable region of the presentation instrument.

13. The kit according to claim 1, wherein the marking medium is suitable for creating an erasable mark on the markable region of the presentation instrument.

14. The kit according to claim 1, wherein the marking medium is suitable for creating an erasable mark on the markable region of the presentation instrument, such that the erasable mark can be made permanent upon activation of the mark.

15. The kit according to claim 1, wherein the marking medium is suitable for creating a permanent mark on the markable region of the presentation instrument.

16. The kit according to claim 1, wherein the information storage medium comprises a magnetic stripe having a track that includes a card number and a cardholder name.

17. The kit according to claim 1, wherein the first side of the presentation instrument is embossed with a user's name, an account number, and an expiration date.

18. The kit according to claim 1, wherein the markable region is designated as a customer markable region.

19. The kit according to claim 1, wherein the markable region is designated by an indicia on the presentation instrument.

20. The kit according to claim 1, wherein the second side of the presentation instrument comprises a signature panel.

* * * * *